US010222140B2

(12) United States Patent
Moreau et al.

(10) Patent No.: US 10,222,140 B2
(45) Date of Patent: Mar. 5, 2019

(54) HEAT EXCHANGER COLLECTOR BOX, IN PARTICULAR FOR A MOTOR VEHICLE, AND CORRESPONDING HEAT EXCHANGER

(75) Inventors: Laurent Moreau, Reims (FR); Sory Sidibe, Reims (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 715 days.

(21) Appl. No.: 14/008,754

(22) PCT Filed: Mar. 30, 2012

(86) PCT No.: PCT/EP2012/055807

§ 371 (c)(1),
(2), (4) Date: May 5, 2014

(87) PCT Pub. No.: WO2012/131046

PCT Pub. Date: Oct. 4, 2012

(65) Prior Publication Data

US 2014/0231053 A1 Aug. 21, 2014

(30) Foreign Application Priority Data

Mar. 31, 2011 (FR) ..... 11 52693

(51) Int. Cl.
*F28F 9/02* (2006.01)
*F28D 1/053* (2006.01)
*F28D 21/00* (2006.01)

(52) U.S. Cl.
CPC ..... *F28F 9/0224* (2013.01); *F28F 9/02* (2013.01); *F28D 1/05366* (2013.01); *F28D 2021/0084* (2013.01)

(58) Field of Classification Search
CPC .. F28F 9/02; F28F 9/0224; F28F 9/022; F28F 9/0246

(Continued)

(56) References Cited

U.S. PATENT DOCUMENTS 6,234,238 B1 5/2001 Koyama et al.
7,201,218 B2 * 4/2007 Hiyama ..... F28F 9/0224 165/173

(Continued)

FOREIGN PATENT DOCUMENTS

DE 102005016941 A1 10/2006
DE 102006053702 * 5/2008

(Continued)

OTHER PUBLICATIONS

Foerster, DE102006053702TRANS (English Translation), May 2008.*
English language machine translation for DE 102005016941 extracted from espacenet.com database on Apr. 14, 2014, 16 pages.
English language abstract and machine translation for DE 102006053702 extracted from espacenet.com database on Apr. 14, 2014, 21 pages.

(Continued)

*Primary Examiner* — Eric Ruppert
(74) *Attorney, Agent, or Firm* — Howard & Howard Attorneys PLLC

(57) ABSTRACT

A collector box (5) is a component of a heat exchanger for a motor vehicle, with the heat exchanger including a heat exchange core with a plurality of heat exchange tubes (3). The collector box (5) includes a fluid collector (9) with a flat bottom (13) to receive the ends of the tubes (3). The fluid collector (9) has two lateral walls (15) extending from the flat bottom (13) and respectively forming a curve between the lateral walls (15) and the flat bottom (13) of a radius (R) of between 1.5 and 4 mm. The fluid collector (9) has a ratio between the burst strength and the height (h) of the collector box (5) that is greater than 10.

12 Claims, 3 Drawing Sheets

Figure 2A:
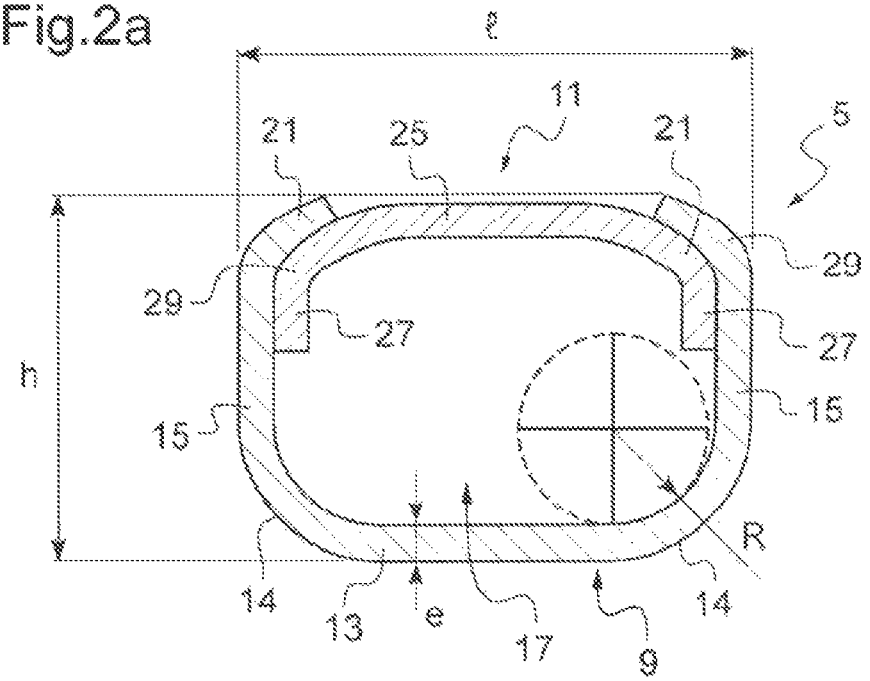

(58) Field of Classification Search
USPC ..... 165/173, 175, 906
See application file for complete search history.

(56) References Cited

U.S. PATENT DOCUMENTS

| | | | | |
|---|---|---|---|---|
| 2004/0069476 | A1 | 4/2004 | Kitazaki | |
| 2005/0161200 | A1 | 7/2005 | Hoffmann et al. | |
| 2005/0223738 | A1* | 10/2005 | Demuth | F28D 1/0476 62/515 |
| 2005/0252648 | A1* | 11/2005 | Helms | F28F 9/0224 165/173 |
| 2011/0272130 | A1* | 11/2011 | Yamazaki | F28D 1/05375 165/185 |

FOREIGN PATENT DOCUMENTS

| | | | | |
|---|---|---|---|---|
| DE | 102006053702 | A1 | 5/2008 | |
| JP | 10132490 | * | 5/1998 | |
| JP | 2005003280 | A | 1/2005 | |
| JP | 2005055037 | * | 3/2005 | |
| JP | WO 2010038672 | A1 * | 4/2010 | F28D 1/05375 |

OTHER PUBLICATIONS

English language abstract and machine translation for JP 2005003280 extracted from PAJ database on Apr. 14, 2014, 35 pages.
International Search Report for Application No. PCT/EP2012/055807 dated Jun. 29, 2012, 7 pages.

* cited by examiner

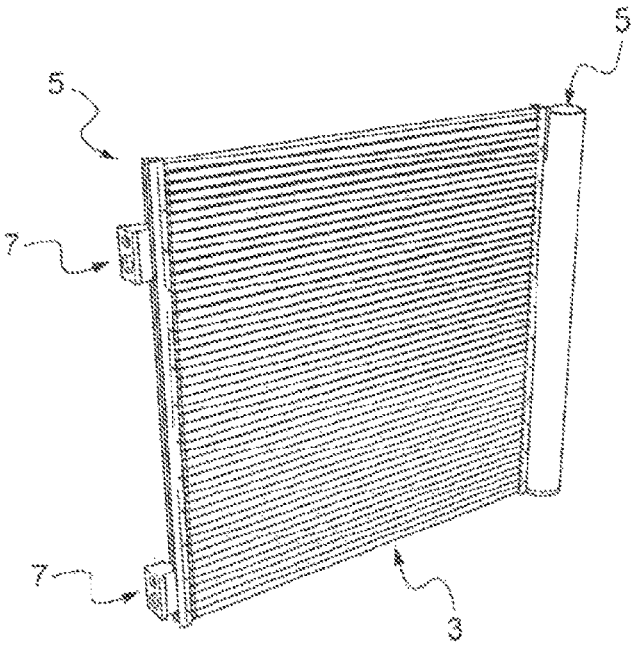
Fig.1
Fig.4
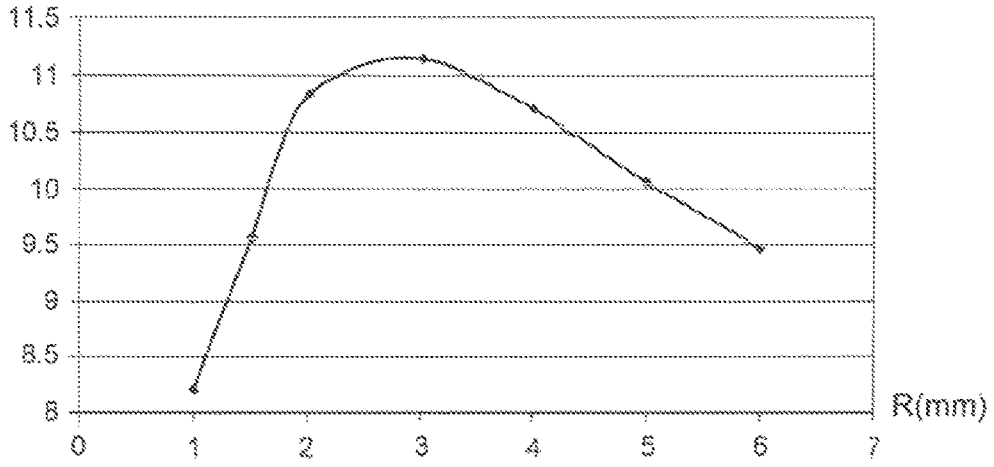

P(Bars)
150
130
90
0
1
1.5
2
3
4
5
6
R(mm)

h(mm)
15
10
0
1
1.5
2
3
4
5
6
R(mm)

HEAT EXCHANGER COLLECTOR BOX, IN PARTICULAR FOR A MOTOR VEHICLE, AND CORRESPONDING HEAT EXCHANGER

RELATED APPLICATIONS

This application claims priority to and all the advantages of International Patent Application No. PCT/EP2012/055807, filed on Mar. 30, 2012, which claims priority to French Patent Application No. FR 1152693, filed on Mar. 31, 2011.

The invention relates to a collector box of a heat exchanger, notably for a motor vehicle.

Heat exchangers used in motor vehicles, for example as condensers in an air conditioning circuit, are already known.

Such a circuit generally comprises a compressor, a condenser or gas cooler, an expansion valve and an evaporator. The condenser is arranged in such a way that it condenses and/or cools the first fluid by exchange of heat with the second fluid.

In this case, the first fluid used may be a refrigerant, such as a Freon-based fluid, and the second fluid may be a cooling fluid such as air.

In general, the heat exchanger comprises a core of heat exchange tubes and a collector box.

In a known solution, the collector box is made as a single piece, for example by extrusion.

Collector boxes made in two parts, namely comprising a collector to accept the ends of the tubes and a lid which is then fixed to the collector to close the collector box in a fluidtight manner, are also known.

Commonly, the collector box has a roughly round overall shape. This configuration provides good burst strength.

However, this configuration leads to excess consumption of material of the tubes housed inside the collector box. Furthermore, having long lengths of tube inside the collector box gives rise to pressure drop problems.

In addition, this configuration has a great height, adding to the overall bulk of the exchanger.

On the other hand, flat-bottomed collectors are also known. However, for burst strength reasons, such collectors are generally very bulky.

It is therefore an objective of the invention to alleviate these disadvantages of the prior art by offering an optimized collector for a heat exchanger that provides good burst strength while at the same time reducing the overall bulk of the collector and therefore of the heat exchanger.

To this end, one subject of the invention is a collector box for a heat exchanger notably for a motor vehicle, comprising a heat exchange core with a plurality of heat exchange tubes, said collector box comprising a fluid collector with a flat bottom to receive the ends of said tubes, characterized in that said collector has two lateral walls extending from said flat bottom and respectively forming a curve between said lateral walls and said flat bottom of a radius of between 1.5 and 4 mm, and in that said collector has a ratio between the burst strength and the height of said collector box that is higher than 10.

Said collector box may further comprise one or more of the following features, considered separately or in combination:

- said radius is of the order of 2 to 3 mm,
- said collector is roughly in the overall shape of a "U",
- said exchanger has a lid to close said collector of a shape that complements the shape of said collector,
- said collector has a height less than 15 mm,
- said height is of the order of 11 mm,
- said collector has a thickness of between 1 and 1.2 mm,
- said collector has flanges to accept the ends of said tubes.

The invention also relates to a heat exchanger notably for a motor vehicle comprising a heat exchange core with a plurality of heat exchange tubes and at least one collector box as defined hereinabove.

According to one embodiment, said exchanger is a condenser notably for an air conditioning circuit in a motor vehicle.

Figure 2B:
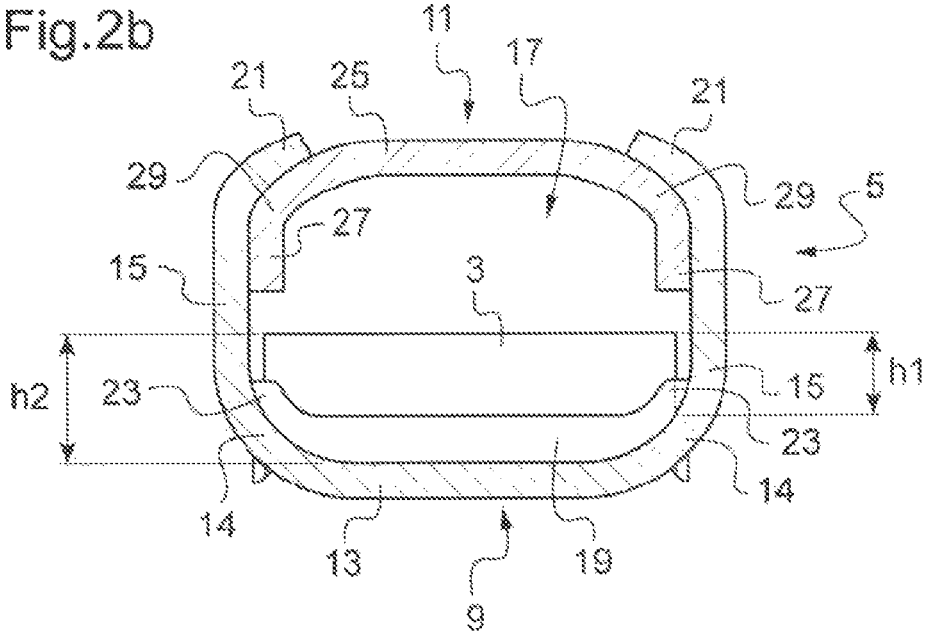
Figure 3A:
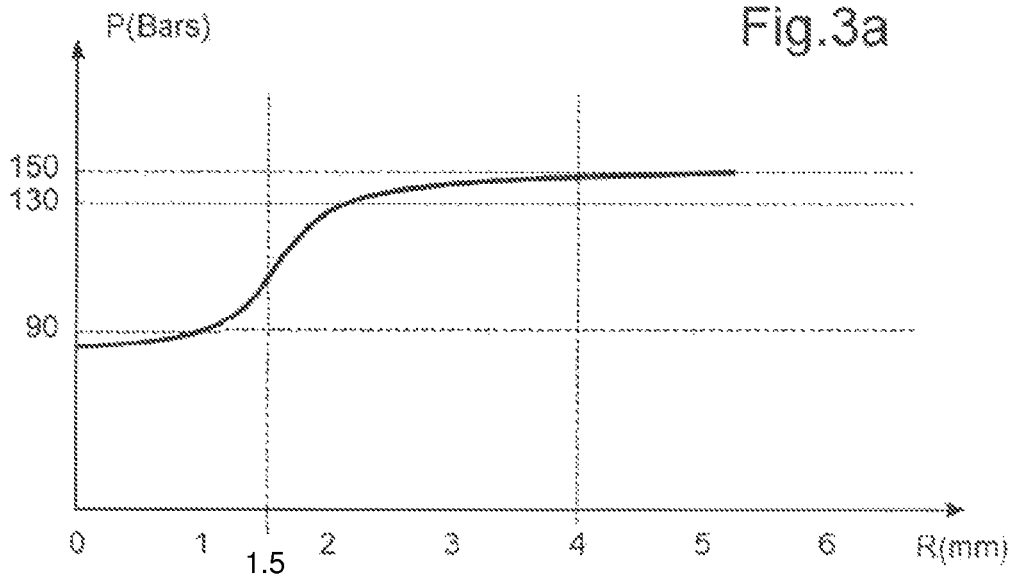
Figure 3B:
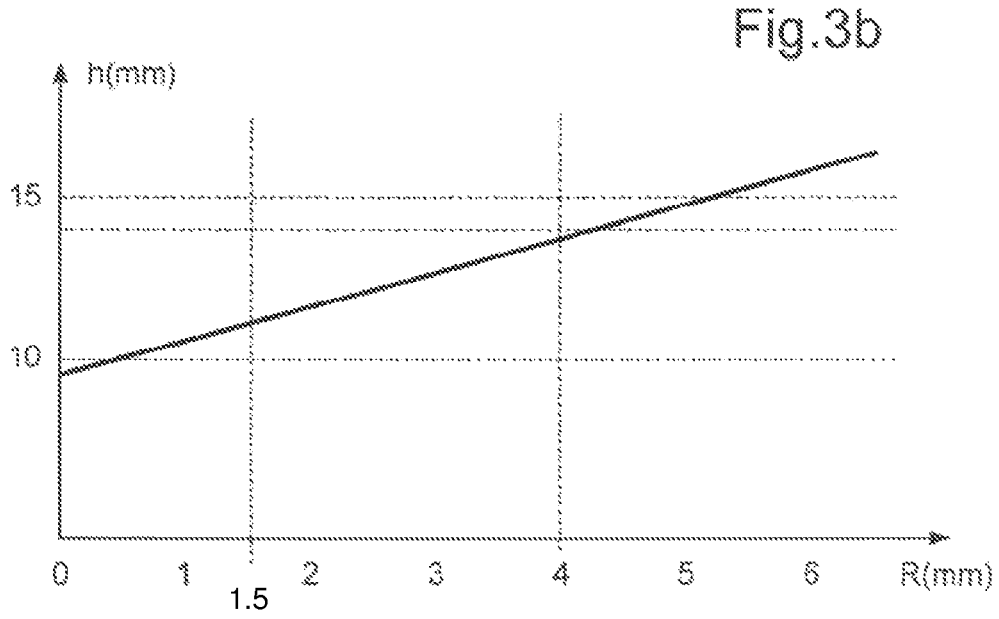

Further features and advantages of the invention will become more clearly apparent from reading the following description, which is given by way of nonlimiting illustrative example, and from studying the attached drawings among which:

FIG. 1 depicts a perspective view of a heat exchanger,

FIG. 2*a* is a view in cross section of a collector box of the exchanger of FIG. 1, comprising a roughly "U"-shaped flat-bottomed collector, FIG. 2*b* is a view in cross section of the collector box of the exchanger of FIG. 1, comprising a roughly "U"-shaped flat-bottomed collector accommodating the tube ends of a heat exchange core of the heat exchanger, FIG. 3*a* is a graph schematically depicting how burst strength varies as a function of the radius of the flat-bottomed collector, FIG. 3*b* is a graph schematically depicting how the height of the flat-bottomed collector varies as a function of the radius of the flat-bottomed collector, and FIG. 4 depicts how the ratio between the burst strength and the height of the collector varies as a function of the radius of the flat-bottomed collector.

In these figures, elements that are substantially identical bear the same references.

FIG. 1 is a simplified depiction of a heat exchanger 1, such as a condenser of an air conditioning circuit, comprising a core made up of a multitude of tubes 3 which are arranged in one or more banks of tubes 3.

The exchanger 1 in the example illustrated comprises two fluid collector boxes 5 so that a fluid can be admitted to flow through the core, then removed.

For this purpose, fluid inlet and outlet couplings 7 are provided, these being in the example illustrated mounted on one collector box 5.

With reference to FIGS. 2*a* and 2*b*, a collector box 5 comprises a flat-bottomed collector-forming part 9 to accept the ends of the tubes 3, just one end of one tube 3 being visible in FIG. 2*b*.

The collector box 5 also has a lid 11 to close the box 5.

According to the embodiment illustrated, the collector 9 and the lid 11 are made as two distinct parts.

According to the embodiment illustrated, the collector 9 has a thickness of material of between 1 and 1.2 mm, for example of the order of 1.2 mm.

The collector 9 has, for example, a width l of the order of 15 mm and a height h of the order of 11 mm.

These dimensions correspond to the dimensions of the closed collector box 5. Thus in this example, the collector box 5 has a width l of the order of 15 mm and a height h of the order of 11 mm.

Such a collector box 5 with a flat-bottomed collector 9 has a more flattened shape by comparison with a collector box that has a round collector, and therefore has a height h which is less than the height of a collector box that has a round collector, thus saving space.

Moreover, the collector 9 by way of example has the rough overall shape of a "U" with a central wall 13 and two lateral walls 15 which extend on either side of the central wall 13. The collector 9 thus delimits a cavity 17.

The collector 9 is flat-bottomed which, according to this example, means that the central wall 13 of the U-shape is roughly flat. This central wall 13 forms the flat bottom of the collector 9.

This central wall 13 has a multitude of transverse slots (not visible in the figures) parallel to one another and the shape of which is tailored to that of the ends of tube 3 that pass through the collector 9.

Provision may also be made for the transverse slots to be bordered by flanges 19 (FIG. 2*b*) to receive the ends of the tubes 3.

According to the example illustrated, the lateral walls 15 extend roughly perpendicular to the central wall 13.

The collector 9 thus has a curve 14 making the connection between the central wall 13 and the lateral wall 15.

At the curve 14 between a lateral wall 15 and the central wall 13, the collector 9 has a radius R (FIG. 2*a*) of between 1.5 and 4 mm.

The greater the radius R, the better the burst strength of the collector 9.

To cite data from calculations carried out by the Applicant:

for a radius R of 1 mm, the burst strength is of the order of 90 bar, for a radius R of 2 mm, the burst strength is of the order of 133 bar, and for a radius R of 3 mm, the burst strength is of the order of 147 bar.

That is illustrated schematically in the graph of FIG. 3*a*, where the radius R in mm is on the abscissa axis and the burst strength P in bar is along the ordinate axis.

However, the greater the radius R, the longer the length by which a tube 3 protrudes into the collector 9.

This is because, referring once again to FIG. 2*b*, each tube 3 inserted into an associated slot of the collector 9, has, on the one hand, a height of tube h1 between the end of the tube 3 inside the collector 9 and the lateral end of the associated slot, and, on the other hand, the height of tube h2 inside the collector 9.

This height h2 corresponds to the height of tube between the end of the tube 3 inside the collector 9 and the point at which the tube 3 enters the associated slot. The reference for the second height h2 is, for example, roughly the middle of the slot.

As illustrated in FIG. 2*b*, the height h1 of tube 3 with respect to the lateral end of the slot is less than the height h2 of tube 3 inside the collector 9.

The first height h1 is defined to optimize exchanger performance, notably for reasons of mechanical strength or reasons concerned with pressure drop.

The height h1 with respect to the lateral end of the slot is therefore determined and it is the height h2 of tube 3 inside the collector 9 which varies according to the shape of the collector 9.

More specifically, the flatter the collector 9, i.e. the smaller the radius R, the smaller this height h2 will be.

In effect, the higher the lateral end of the slot, the greater will be the proportion of tube protruding into the collector 9 because the height h1 of tube with respect to this lateral end is fixed. The greater the radius R, the higher the lateral end of the slot. The height h2 of tube inside the collector 9 therefore increases with the radius R.

By contrast, the lower the lateral end of the slot, the smaller will be the proportion of tube protruding into the collector 9 because the height h1 of tube with respect to this lateral end is fixed. The smaller the radius R, the lower the lateral end of the slot. The height h2 of tube inside the collector 9 decreases with the radius R.

This increase in the amount of protrusion of a tube 3, i.e. this increase in the height of tube h2 inside the collector 9, leads to a significant increase in the height h of the collector 9.

The increase in collector box height with the radius R is depicted schematically by a linear straight line on the graph of FIG. 3*b* where the radius R in mm is on the abscissa axis and the height h of the collector box 5 in mm is on the ordinate axis.

In order not to generate an excess additional consumption of material for the tube 3 and, therefore, an increase in the height of the collector 9 and hence of the collector box 5 and hence of the overall size of the exchanger 1, the radius R needs not to be too great.

With reference to the graphs of FIGS. 3*a*, 3*b*, when the radius R is between 1.5 and 4 mm, a good burst strength is obtained with a height h of collector box 5 less than 15 mm, for example between 10 and 15 mm.

Such a radius R therefore allows a space saving.

Specifically, as mentioned previously, the height h2 of tube inside the collector 9 decreases the flatter the collector 9 and therefore decreases with the radius R.

If the same length of tube 3 is maintained as used in the solutions of the prior art, when the radius R decreases the height h2 of tube inside the collector decreases and therefore the ratio between the height of tube 3 for heat exchange and the height h2 protruding into the collector 9 increases.

It is therefore the height of tube 3 dedicated to heat exchange which increases without the need for additional material.

For the same size, the heat exchange performance is therefore improved.

As an alternative, if it is the height of tube 3 available for heat exchange that is fixed, with the height h2 decreasing with the radius R, the total length of the tube 3 is reduced and material is saved.

This height h less than 15 mm and the radius R of between 1.5 and 4 mm allow the overall size of the exchanger 1 to be decreased by comparison with the solutions of the prior art, while at the same time ensuring a good burst strength.

Specifically, by creating a ratio of burst strength to height h of collector 9, as illustrated by the bell-shaped curve in the graph of FIG. 4 where the radius R in mm is along the abscissa axis and the aforementioned ratio is on the ordinate axis, the optimized ratios, namely the top of the bell-shaped curve, fall for a radius R of between 1.5 and 4 mm, and in particular, for a radius R of the order of 2 to 4 mm.

Specifically, with a radius R of between 1.5 and 4 mm, the ratio between the burst strength and the height of the collector box is higher than 10.

The Applicant has noticed an optimized solution for a radius R of the order of 2 to 3 mm with a height h of collector box 5 of the order of 11 mm.

Moreover, referring once again to FIGS. 2*a*, 2*b*, the lateral walls 15 of the collector 9 have, at their ends, crimping tabs 21 which are intended to be bent over toward the inside of the cavity 17 so that they press against the external face of the lid 11.

As far as the lid 11 is concerned, the latter has, for example, roughly the same thickness as the collector 9, namely in this instance a thickness of between 1 and 1.2 mm.

As mentioned previously, the lid 11 has a shape that complements that of the collector 9.

According to the embodiment illustrated, the lid 11 is also roughly in the overall shape of a "U" with a central wall 25 and two lateral walls 27 extending on either side of the central wall 25.

The central wall 25 may be substantially flat in a similar way to the flat bottom of the collector 9.

According to the example illustrated, the lateral walls 27 extend substantially perpendicular to the central wall 25. The lid may have a curvature 29 forming the connection between the central wall 25 and a lateral wall 27.

This curvature 29 is of a shape that complements the shape of the crimping tabs 21 of the collector 9 so that the lid 29 can be immobilized inside the cavity 17.

In order to allow the lid 11 to be introduced into the cavity 17 delimited by the collector 9, the distance separating the external faces of the lateral walls 27 of the lid 11 is roughly, with lower values, equal to the distance which separates the internal faces of the lateral walls 15 of the collector 9.

An "external face" means a face facing toward the outside of the cavity 17. And an "internal face" means a face facing toward the inside of the cavity 17.

Likewise, the distance separating the external faces of the curves 29 of the lid 11 is roughly, with lower values, equal to the distance separating the internal faces of the crimping tabs 21 of the collector 9.

It will therefore be appreciated that a flat-bottomed collector having a radius R of the order of 1.5 to 4 mm at the curve that connects the flat bottom of the collector 9 to the lateral walls 15 saves space and gives an optimized ratio between the burst strength and the height h of the collector box 5.

The invention claimed is:

1. A collector box (5) for a heat exchanger for a motor vehicle, the heat exchanger comprising a heat exchange core with a plurality of heat exchange tubes (3), wherein said collector box (5) comprises a fluid collector (9) with a flat bottom (13), wherein said flat bottom (13) receives the ends of the tubes (3), and wherein:

said fluid collector (9) has two lateral walls (15) extending from said flat bottom (13) and respectively forming a curve between said lateral walls (15) and said flat bottom (13) of a radius (R) of between 1.5 and 4 mm, said collector box (5) further comprises a lid to close said fluid collector (9), said fluid collector (9) is in the shape of a "U" having said flat bottom (13) and two lateral walls (15) extending from said flat bottom (13) and delimits a cavity (17), wherein said lateral walls (15) each include a crimping tab (21) at their ends which are configured to be bent over towards said cavity (17) such that said crimping tabs (21) press against a top external face of said lid and said lid is disposed within said cavity (17);

wherein said lid is of a shape that complements the shape of said fluid collector (9) such that said lid includes a flat central wall (25), two lateral walls (27) extending from said flat central wall (25), and curvatures (29) forming connections between said flat central wall (25) and said two lateral walls (27) of said lid which complements the shape of said crimping tabs (21); and wherein said collector box (5) has a height (h) of approximately 11 mm and has a thickness (e) of between 1 and 1.2 mm.

2. The collector box (5) as claimed in claim 1, wherein said radius (R) ranges from 2 to 3 mm.

3. The collector box (5) as claimed in claim 1, wherein said fluid collector (9) has flanges (19) to accept the ends of the tubes (3).

4. A heat exchanger for a motor vehicle, said heat exchanger comprising a heat exchange core with a plurality of heat exchange tubes (3) and at least one collector box (5) in accordance with claim 1.

5. The heat exchanger as claimed in claim 4, as a condenser for an air conditioning circuit in the motor vehicle.

6. The collector box (5) as claimed in claim 2, further comprising said lid to close said fluid collector (9) of a shape that complements the shape of said fluid collector (9).

7. The collector box (5) as claimed in claim 1, wherein said two lateral walls (15) and said flat bottom (13) delimit a single cavity.

8. The collector box (5) as claimed in claim 1, wherein said lateral walls (15) extend substantially perpendicular from said flat bottom (13).

9. The collector box (5) as claimed in claim 1, wherein said flat bottom (13) and said two lateral walls (15) form said "U" shape.

10. The collector box (5) as claimed in claim 1, wherein said crimping tabs (21) of said collector (9) immobilize said lid inside said cavity (17).

11. The collector box (5) as claimed in claim 1, wherein said fluid collector (9) has a ratio between a burst strength and the height (h) of said collector box (5) that is greater than 10 bar/mm, and wherein said burst strength corresponds to said radius (R) as a function of said radius (R).

12. A collector box (5) for a heat exchanger for a motor vehicle, the heat exchanger comprising a heat exchange core with a plurality of heat exchange tubes (3), wherein said collector box (5) comprises a fluid collector (9) with a flat bottom (13), wherein said flat bottom (13) receives the ends of the tubes (3), and wherein:

said fluid collector (9) has two lateral walls (15) extending from said flat bottom (13) and respectively forming a curve between said lateral walls (15) and said flat bottom (13) of a radius (R) of between 1.5 and 4 mm, said collector box (5) further comprises a lid to close said fluid collector (9), said fluid collector (9) is in the shape of a "U" having said flat bottom (13) and two lateral walls (15) extending from said flat bottom (13) and delimits a cavity (17), wherein said lateral walls (15) each include a crimping tab (21) at their ends which are configured to be bent over towards said cavity (17) such that said crimping tabs (21) press against a top external face of said lid and said lid is disposed within said cavity (17);

wherein said lid is of a shape that complements the shape of said fluid collector (9) such that said lid includes a flat central wall (25), two lateral walls (27) extending from said flat central wall (25), and a curvatures (29) forming connections between said flat central wall (25) and said two lateral walls (27) of said lid which complements the shape of said crimping tabs (21); and wherein said collector box (5) has a height (h) of between 10.5 mm and less than 15 mm and has a thickness (e) of between 1 and 1.2 mm.

* * * * *